US006426593B1

(12) United States Patent
Nieberger et al.

(10) Patent No.: US 6,426,593 B1
(45) Date of Patent: Jul. 30, 2002

(54) METHOD AND APPARATUS FOR ILLUMINATING TWO DEPENDENT INDICATORS WITH A SINGLE OUTPUT PIN

(75) Inventors: Mathew A. Nieberger, Rocklin; Kristie Amanna, Roseville; Terry W. Smith, Rescue, all of CA (US)

(73) Assignee: Hewlett-Packard Co., Palo Alto, CA (US)

( * ) Notice: Subject to any disclaimer, the term of this patent is extended or adjusted under 35 U.S.C. 154(b) by 0 days.

(21) Appl. No.: 09/629,199

(22) Filed: Jul. 31, 2000

(51) Int. Cl.[7] ..... G09G 3/06

(52) U.S. Cl. ..... 315/131; 315/291; 345/44

(58) Field of Search ..... 315/200 A, 209 R, 315/209 CD, 241 S, 241 P, 185 S, 185 R, 119–124, 360, 362, 129–133; 362/800; 345/44–46

(56) References Cited

U.S. PATENT DOCUMENTS

| | | | | |
|---|---|---|---|---|
| 4,797,556 A | | 1/1989 | Marzari et al. | 250/551 |
| 4,924,177 A | | 5/1990 | Mulz | 324/133 |
| 5,359,290 A | | 10/1994 | Cervas | 324/384 |
| 5,424,613 A | * | 6/1995 | Moriarty, Jr. | 315/209 R |
| 5,578,905 A | * | 11/1996 | Graber | 315/76 |
| 5,874,930 A | * | 2/1999 | McRobert et al. | 345/44 |
| 5,959,413 A | | 9/1999 | Komarek et al. | 315/306 |
| 6,037,874 A | | 3/2000 | Heironimus | 340/686.1 |

* cited by examiner

*Primary Examiner*—Don Wong
*Assistant Examiner*—Wilson Lee
(74) *Attorney, Agent, or Firm*—David M. Mason

(57) ABSTRACT

A display apparatus for selectively controlling the illumination of two dependent visual indicators with a single control line. The apparatus includes two visual indicators, two amplifiers, and a logic circuit. The same end of the two visual indicators connect to a conductive terminal. A first amplifier connects between the line and the other end of one indicator and a second amplifier connects between the line and the other end of the other indicator. A combination of signals applied to the two inputs selectively illuminates one or both indicators with one signal from the control line. The inventive circuit designs of the present invention are compact in size, elegant in its simplicity and operation, and miserly in its power consumption. Therefore, a minimal amount of power will be used to highly illuminate one or two visual indicators being dependent on one another with the use of a single control pin of an IC.

17 Claims, 1 Drawing Sheet

METHOD AND APPARATUS FOR ILLUMINATING TWO DEPENDENT INDICATORS WITH A SINGLE OUTPUT PIN

BACKGROUND OF THE INVENTION

1. Field of the Invention

The present invention generally relates to a display apparatus, and more particularly to an apparatus for controlling the illumination of two dependent visual indicators with a single output pin of an integrated circuit.

2. Description of the Related Art

Most electronic devices today, such as a printer, modem, computer, server, pager, phone, etc., utilize visual indicators, such as a light emitting diode ("LED"), to display various operational conditions of the device to the user. In the same conventional devices, each visual indicator is independently driven using separate pins of an application specific integrated circuit ("ASIC"). This type of conventional display apparatus is undesirable in that it is "pin constrained". In other words, an excessively large number of IC pins are required to drive a large-scale display apparatus.

Another factor of a conventional display device is that the current that is required from the ASIC for driving each visual indicator determines the drive strength of the pad cell. As the amount of current provided by the ASIC increases so does the drive strength of the pad cell. Therefore, more power, and hence power and ground pins on the ASIC are required to drive the display.

Still another factor of a conventional display device involves the brightness and process for illuminating various LED colors. When a conventional display apparatus having a red and a green colored LED needs to produce an amber color, both the red and green LED must be simultaneously illuminated. To do this, two pins of an ASIC must be activated simultaneously. Therefore, twice the power must be used to create an amber colored indicator. Similarly, when a display apparatus needs to illuminate a high threshold voltage LED or light colored LED, such as yellow, the standard power used for the low threshold voltage LED or dark colored LED, such as red, green, blue, etc., is not adequate. Therefore, a conventional display apparatus that needs to effectively illuminate a yellow LED must increase the power to the respective ASIC pin for the same.

In summary, each additional pin of an integrated circuit ("IC") or ASIC required to drive the visual indicators of a conventional display device eliminates other possible functions that the pins of the IC could be used for, or forces the use of larger and more expensive IC packages to drive the display device. In addition, conventional display devices can not display an amber color without simultaneously activating a red and a green LED, and can not effectively illuminate a high threshold voltage LED.

It is an object of the present invention to overcome some, if not all of the limitations of a convention display apparatus as described above.

SUMMARY OF THE INVENTION

In one embodiment of the invention an apparatus is provided for illuminating two dependent visual indicators with a single control line. The apparatus includes two visual indicators, two amplifiers, and a logic circuit. The same end of the two visual indicators connect to a conductive terminal. A first amplifier connects between the line and the other end of one indicator and a second amplifier connects between the line and the other end of the other indicator. A combination of signals applied to the two inputs selectively illuminates one or both indicators with one signal from the control line.

In another embodiment of the present invention, a process is disclosed for controlling the illumination of two dependent visual indicators with a single control line coupled to a logic circuit. The process includes simultaneously providing one of a HIGH and a LOW signal to a first and second input of the logic circuit to create one signal on the one control line. The signal on the control line illuminates the two indicators simultaneously, illuminates one of the two visual indicators or fails to illuminate either of the two indicators.

BRIEF DESCRIPTION OF THE DRAWINGS

These and other objects of the invention will be apparent from the following detailed description in connection with the attached drawings, in which.

Figure 1:
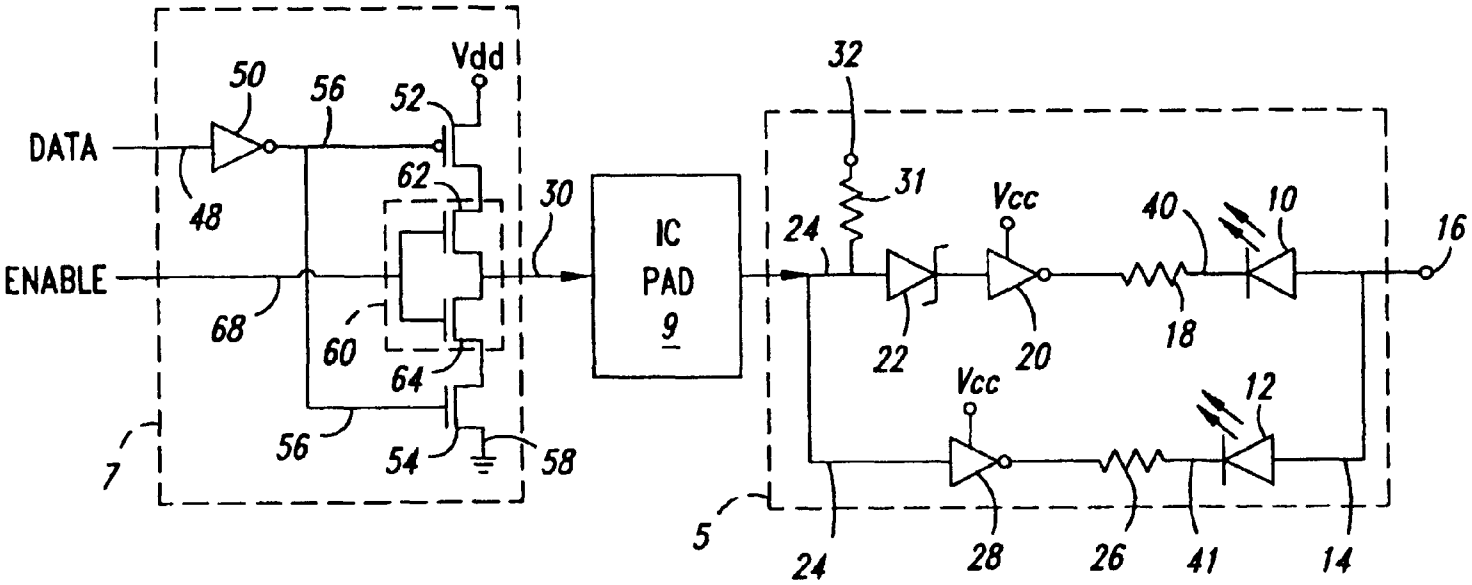
FIG. 1 is a schematic circuit diagram of a display device embodying the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Broadly stated, the display apparatus of the present invention includes a pair of indicator lights that are operationally dependent on each other, and yet adapted to have one of the two or both indicator lights be selectively turned on and off with one signal applied to a single control line. The ability to control the operation of two dependent indicator lights with a single control line minimizes the number of output pins that are used from an electronic integrated circuit ("IC").

The present invention also provides a unique amplifier that either increases the voltage and/or current to one or both of the indicator lights from the single control line. This enables the indicator lights to be brighter (more current) or cheaper (requiring higher voltage) than before, and removes the burden of having to provide more current or higher voltages at the control line.

The inventive configurations to be described in detail below will allow the driving application specific integrated circuit ("ASIC") to use a lower drive strength pad cell, thus reducing the required power and hence number of power and ground pins required on the ASIC. Consequently, these configurations will allow for smaller scaled and cheaper ASIC designs and the use of cheaper and higher threshold visual indicators to be effectively illuminated.

Turning now to the Drawings, FIG. 1 illustrates a circuit diagram in accordance with a preferred embodiment of the present invention. Generally, the illustrated circuit diagram provides a display drive circuit 5 connected to a logic circuit 7 having an IC pad 9 connected therebetween. With this arrangement, only one conductive control line from the IC pad 9 is necessary to operate the drive circuit 5 with the single logic output 30 of the logic circuit 7.

The drive circuit 5 includes a pair of visual indicators that are preferably light emitting diodes (LEDs) 10 and 12 coupled in parallel such that the anode of LED 10 connects to the anode of LED 12 by line 14. Line 14 also connects to a conductive terminal 16, such as a power source Vcc. The cathode of LED 10 serially couples to the IC pad 9 through a current limiting resistor 18, an inverting amplifier 20, and a zener diode 22. In particular, the current limiting resistor 18 connects between the cathode of the LED 10 and the output of the inverting amplifier 20. The input of the inverting amplifier 20 connects to the cathode of the zener diode 22, and the anode of the zener diode 22 connects to the IC pad 9, via the IC control line 24.

Similar to LED 10, the cathode of LED 12 serially couples to the IC pad 9 through resistor 26 and inverting amplifier 28. In particular, the current limiting resistor 26 connects between the cathode of the LED 12 and the output of the inverting amplifier 28, and the input of the inverting amplifier 28 connects to the IC pad 9, via IC control line 24. Lastly, a pull-up resistor 31 connects to the IC control line 24 at one end and to a power source 32 at the other end.

A skilled artisan will appreciate that the inverting amplifiers 20 and 28 work together with the zener diode 22, and resistors 18, 26 and 31 to raise the voltage driven to Vcc and amplify the current from the control line 24 to illuminate LEDs 10 and 12. The zener diode provides a turn-on voltage Vz that is less than or equal to Vdd divided by two, and the power source for pull-up resistor 32 provides a voltage of less than or equal to Vz. The zener diode 22 may be replaced by a group of diodes in series whose properties have a combined Vz as appropriate. Similarly, the inverting amplifiers 20 and 28 may be part of the same package, i.e., a 7404 TTL, or build discretely out of transistors or other components.

In an alternative embodiment, the anode to cathode direction of one or both visual indicators 10 and 12 may be flipped so that the tied end 14 reverts to a ground terminal instead of a power source of Vcc. With such a configuration, a buffer instead of the inverting amplifiers 20 and 28 drives the visual indicators 10 and 12. In addition, the current limiting resistors 18 and 26 may be connected to either the cathode or anode terminal of the visual indicators 10 and 12 and be imbedded in either the driver's or diode's package circuitry.

In accordance with an important aspect of the present invention, the two LEDs 10 and 12 can be independently controlled by one signal derived from logic output 30 of the logic circuit 7, which moves through IC pad 9 to the single control line 24 before reaching either LED 10 and 12. The IC pad 9 plus logic circuit structure 7 is preferably a standard output buffer having three output states, which are identified as Drive-High, Drive-Low and Drive-Disable. In this preferred embodiment, the output states provide either an approximate voltage level of Vcc or Ground.

With the above circuit configurations, the current for driving the visual indicators is not limited by the current drive strength of the IC pad 9, as with the conventional display apparatus configurations described earlier. Instead, the inventive configurations allow for the current from the IC pad 9 to be amplified, and potentially voltage level shifted by the external drivers. This is accomplished by using the three potential states of the standard IC pad output buffer.

The components of the logic circuit structure 7 of FIG. 1 include a DATA signal inverter 50 connected between input line 48 and the gates of the transistors 52 and 54, via line 56. The source of transistor 52 connects to a voltage supply Vdd, and the drain of transistor 54 connects to a ground terminal 58. A conventional logic enable or pass gate 60, comprising serially coupled transistors 62 and 64, create a serial connection from the drain of transistor 52 to the source of transistor 54. As mentioned above, the output of the logic pass gate 60 connects to the input of the IC pad 9, via the logic output 30. The input of the logic pass gate 60 supplies the gates of transistors 62 and 64 with an ENABLE signal, via input line 68.

Generally, a HIGH signal applied to DATA line 48 will switch transistor 52 into a conductive state ("ON") and switch transistor 54 into a non-conductive state ("OFF"). Conversely, a LOW signal applied to DATA line 48 will switch transistor 52 OFF and switch transistor 54 ON. However, as will be discussed in more detail below, current will only flow through either transistor 52 or 54 to the IC pad 9, via transistors 62 and 64 respectively, if the signal applied to the ENABLE line 68 is HIGH to activate the gates of the logic pass gate transistors 62 and 64.

To better understand the operation and functionality of the inventive circuitry shown in FIG. 1, reference will now be provided in view of Table 1.

TABLE 1

| DATA Line 48 | ENABLE Line 68 | PAD STATE Line 24 | Zener Diode 20 | Invert Amp 18 | Invert Amp 32 | Diode 10 | Diode 12 |
|---|---|---|---|---|---|---|---|
| "Don't Care" | LOW | Disable-Drive | OFF | Vcc | Vcc | OFF | ON |
| LOW | HIGH | Drive-LOW | OFF | Vcc | Gnd | OFF | OFF |
| HIGH | HIGH | Drive-HIGH | ON | Gnd | Vcc | ON | ON |

When the ENABLE line 68 receives a LOW signal input, transistors 62 and 64 switch OFF to a "Don't Care" DATA condition. With this condition, no current flows through the transistors 62 and 64 of the logic pass gate 60. In addition, the IC pad 9 is biased to some value greater than VIL (the turn on voltage of the inverter 28) and less than Vz (the turn on voltage of the zener diode 22) at the input of inverting amplifier 28 and the zener diode 22, via the pull-up resistor 31. In other words, the zener diode 22 will not be forward biased, and hence OFF. The input to the inverting amplifier 28 is HIGH therefore the output is LOW. The input to the inverting amplifier 20 is LOW therefore its output is HIGH or Vcc. Consequently, LED 12 will be properly forward biased and on and LED 10 is reverse biased so it is OFF.

In contrast, when the ENABLE line 68 receives a HIGH signal input, transistors 62 and 64 switch to an ON state, and a selected one of the LEDs 10 and 12 is illuminated depending on the input signal received at the DATA line 48. Thus, for the remaining state conditions of Table 2, the ENABLE line 68 will provide a HIGH signal input.

When the DATA line 48 receives a LOW signal input (i.e., ENABLE line 68 provides a HIGH signal input), current flows to the Ground terminal 58 of the logic circuit 7 from the IC pad 9, via transistors 64 and 54. At such time, the IC pad 9 provides a ground state plus any parasitic resistance, and the zener diode 22 will not be properly forward biased, and hence OFF. The inputs to inverting amplifiers 20 and 28 are LOW therefore their outputs are HIGH or Vcc. Consequently, LEDs 10 and 12 will be reverse biased and OFF.

When the DATA line 48 receives a HIGH signal input (i.e., ENABLE line 68 provides a HIGH signal input), transistor 52 switches ON and transistor 54 switches OFF. While transistor 52 is ON, current flows through transistors 52 and 62, via power supply Vdd, to logic output 30 and IC pad 9. The IC pad 9 provides a voltage similar to Vdd minus any parasitic resistance to the inputs of zener diode 22 and the inverting amplifier 28, via control line 24. Since this voltage is greater than the turn-on voltage of the zener diode 22 (i.e., Vz<Vdd/2) and the inverting amplifier 28 (i.e., $V_{IL}$), the zener diode 22 and the inverting amplifiers 20 and 28 are properly forward biased to be ON, therefore the output of inverting amplifiers 20 and 28 is LOW. The LOW output from the inverting amplifiers 20 and 28 will properly forward bias, via current limiting resistors 18 and 26, each LED 10 and 12 to be illuminated or ON.

With the above embodiment of FIG. 1, a preferred application of the drive circuit 5 would utilize a standard red and green colored LED. However, the preferred method would only drive green and amber by locking out red. In other words, to avoid the illumination of a red visual indicator (which may carry specific cultural perceptions), the LED 10 would be red and the LED 12 would be green so that the only colors that the display apparatus could provide would be green and amber. Therefore, by using the inventive display apparatus configuration, a single signal of one control line or pin can produce an amber and a green indicator.

The inventive display elements or apparatuses described above may be used in any application requiring the control of two indicator lights that are dependent on each other. A useful application of the present invention may be selected from the group including a computer, a scanner, a print server, a signal transmitting and/or receiving device (e.g., modem, pager, cellular phone, remote control), a control panel, etc. However, according to a preferred embodiment, the inventive display element will be incorporated in a print server.

Figure 2:
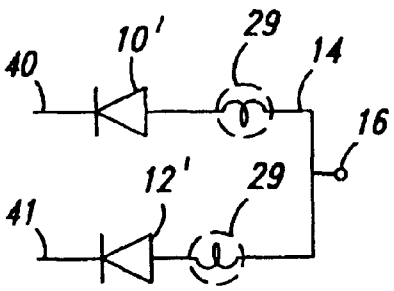
FIG. 2 is an alternative embodiment of the visual indicators shown in FIG. 1.

For either of the inventive embodiments described above, a person of ordinary skill in the relevant arts should appreciate that the indicator lights or LEDs 10 and 12 of either embodiment may be formed of a standard diode 10' or 12' connected in series with a lamp 29 as shown in FIG. 2. During manufacturing, the LEDs 10 and 12 may be separately formed, or may be provided in a single unitary package. Consequently, the components of the display circuit 5 are preferably located external to the logic circuit 7 of the related display element of an electronic device.

The inverting amplifiers 20 and 28 for the above embodiments may be as simple as 2 resistors plus a BJT configured as a conventional RTL logic circuit up through today's fully integrated digital logic inverter. The only significant requirement is that the inverting amplifier of chose can be made compatible with the IC pad 9 such that: the IC pad voltage Voh is greater than the voltage Vih for each inverting amplifier, the IC pad voltage Vol is less then the voltage Vil for each inverting amplifier, and a decent separation and rudimentary hysterisis is created between Vih & Vil for the display circuit 5. The voltage "amplification" is accomplished if Vcc of the inverting amplifier is greater than Vdd of the ASIC.

The functional components that make-up the logic circuit 7 and IC pad 9 in the above embodiments is just one of many possible representations of what is collectively know in the industry as a "tri-stateable output buffer" or an "output buffer with enable" circuit. These circuits are available from most ASIC vendors. The present invention uses the "basic" output characteristics of such a circuit to enable the unique amplification and LED driver or display circuit 5.

The transistors 52, 54, 62 and 64 illustrated in the logic circuit of FIG. 1 are preferably CMOS transistors. However, persons of ordinary skill in the relevant arts should appreciate that other types of transistors or other configurations of logic elements could be used to carry out the operation of the logic circuit 7, i.e., to provide the desired signals on logic output 30 and control line 24.

From the foregoing, it should be appreciated that an improved display apparatus has been shown and described which offers many advantages and desirable attributes compared to prior art display apparatuses.

For example, the present invention conserves utilization of precious output pins of integrated circuits, in that it can selectively illuminate one of two or both operationally dependent visual indicators with a single output pin of an IC. In other words, with the above embodiments, two dependent LEDs of nearly any electronic device or application can be independently controlled by one signal on a single control line.

The inventive display apparatus provides a unique amplifier to either increase the voltage and/or current to a select one of both of the LEDs from the IC pad. This enables one or both of the LEDs to be brighter (more current) or cheaper (requiring higher voltage) than before. This removes the burden of more current or higher voltage from the IC pad to effectively illuminate high and low threshold voltage LEDs. In addition, the ASIC can use a lower drive strength pad cell to reduce the required power, and hence number of power and ground pins of the ASIC.

In summary, the inventive circuit designs of the present invention are compact in size, elegant in its simplicity and operation, and miserly in its power consumption. Therefore, a minimal amount of power will be used to highly illuminate one or more of the LED's during operation using a single control pin of an IC.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. An apparatus for illuminating two visual indicators with one control line, the apparatus comprising:

a logic circuit having two signal inputs and one control line;

an IC pad connected between the two inputs and the control line;

two visual indicators connect in parallel, the anode of each indicator connects to a power source;

a first amplifier connects between the line and the cathode of one indicator; and a second amplifier connects between the line and the cathode of the other indicator, wherein a combination of signals applied to the two inputs selectively illuminates one or both indicators with one signal from the control line.

2. The apparatus of claim 1, wherein:

the first amplifier includes a zener diode and an inverting amplifier, the anode of the zener diode being coupled to the control line, the cathode of the zener diode being connected to the input of the inverting amplifier, and the output of the inverting amplifier being coupled to the cathode of the first indicator; and the second amplifier includes an inverting amplifier having an input connected to the control line and a output coupled to the cathode of the second indicator.

3. The apparatus of claim 1, further comprising a resistor connected between each amplifier and the cathode of the respective indicator.

4. The apparatus of claim 1, wherein the IC pad is an output buffer having three output states being selected from Drive-High, Drive-Low and Drive-Disable.

5. The apparatus of claim 1, wherein the logic circuit further comprising:

a power source;

a ground terminal;

four serially coupled transistors, the source of the first transistor being coupled to the power source, the drain of the fourth transistor being coupled to the ground terminal, the gates of the second and third transistors being coupled to one of the two inputs, and the drain of the second transistor and the source of the third transistor being coupled to the logic input of the IC pad; and an inverter couples between the other input of the two inputs and the gates of the first and four transistors.

6. The apparatus of claim 1, wherein the logic circuit is a device being selected from the group including a microprocessor, an ASIC and an array of logic gates.

7. The apparatus of claim 1, wherein the two indicators and the amplifiers are contained in a common package separate from the logic circuit.

8. The apparatus of claim 1, wherein the amplifier amplifies the signal from the control line to increase the brightness of the visual indicator being illuminated.

9. An apparatus for controlling the illumination of two visual indicators with a single control line, the apparatus comprising:

a conductive terminal;

two visual indicators connected in parallel with the cathode to anode direction being the same for each indicator, a first end of the two indicators being connected to the terminal;

a logic element having two inputs and the control line; and first and second inverting amplifiers, the first amplifier being connected between the control line and one of the two visual indicators at the second end and the second inverting amplifier being connected between the control line and the other visual indicator at the second end, wherein the two indicators simultaneously illuminate when the inputs receive the same signal.

10. The apparatus of claim 9, wherein the first and second amplifiers further include a resistor connected between the first and second inverting amplifiers and the first and second ends, respectively.

11. The apparatus of claim 9, wherein the control line illuminates one of the indicators when the logic circuit provides a disable voltage level to the control line.

12. The apparatus of claim 10, further comprising:

a zener diode connected between the control line and the first inverting amplifier; and a resistor connected between a voltage source and the control line.

13. The apparatus of claim 12, wherein the IC pad selectively provides one of a HIGH, LOW and MEDIUM voltage level on the single control line when combinations of HIGH and LOW signals are received by the two inputs of the logic element to illuminate one or both visual indicators.

14. A method for controlling the illumination of two visual indicators with a single control line coupled to a logic circuit, the method comprising:

providing one of a HIGH and LOW signal to an ENABLE and a DATA input of the logic circuit to produce one signal on the control line; and amplifying the one signal on the control line to increase the illumination of one of the two visual indicators, wherein the one signal illuminates the two indicators simultaneously, illuminates one of the two visual indicators or fails to illuminate either of the two indicators.

15. The method of claim 14, further including applying a LOW signal to the DATA input to prevent the illumination of the two indicators.

16. The method of claim 14, further including applying a HIGH signal to the DATA input to simultaneously illuminate the two indicators.

17. The method of claim 14, further including applying a LOW signal to the ENABLE input to illuminate one of the two indicators.

* * * * *